United States Patent [19]

Nicol

[11] Patent Number: 4,511,050

[45] Date of Patent: Apr. 16, 1985

[54] DOSE INDICATOR CLOSURE

[76] Inventor: Irene L. Nicol, 225 Cloverdale, Villas, N.J. 08251

[21] Appl. No.: 606,402

[22] Filed: May 2, 1984

[51] Int. Cl.[3] ..... B65D 55/02

[52] U.S. Cl. ..... 215/219; 215/206; 116/308; 206/534

[58] Field of Search ..... 215/206, 219, 220; 116/308; 206/534

[56] References Cited

U.S. PATENT DOCUMENTS

| | | | |
|---|---|---|---|
| 2,767,680 | 10/1956 | Lermer | 116/308 |
| 2,817,451 | 12/1957 | Giles et al. . | |
| 3,151,599 | 10/1964 | Livingston | 116/308 |
| 3,753,417 | 8/1973 | Garby | 116/308 |
| 3,921,568 | 11/1975 | Fish | 116/308 |
| 4,011,829 | 3/1977 | Wachsmann et al. | 116/308 |
| 4,220,247 | 9/1980 | Kramer | 215/219 |

*Primary Examiner*—George T. Hall

[57] ABSTRACT

A Dose reminder type, two piece closure which may be attached to a container by conventional capping Machines. An inner cap member is formed with a circular top panel having a depending skirt integrally molded therewith. The depending skirt is threaded on its interior surface for engagement with a conventional threaded container finish. A flanged portion bearing indicia is integrally formed, projecting radially outwardly from the base of the depending skirt. An outer cap member is also formed with a circular top panel and an integral depending skirt ending at the base in a series of symmetrical dyhedral configurations. The bias of the dyhedral contour matches evenly with a like shaped track integrally formed around the inner diameter of the aforementioned inner cap member flange. This arrangement permits positive engagement of the two member closure for removal from a container. However, when the closure is fully reengaged on the container, the outer member containing an indicator means can be advanced to the next indexing point with a slight pressure continuing in the engagement direction.

4 Claims, 4 Drawing Figures

DOSE INDICATOR CLOSURE

BACKGROUND OF THE INVENTION

1. Field of the Invention

This invention related generally to closure members for containers, and particularly to closure members of the dose reminder type. More specifically, this invention relates to a dose reminder type closure having an improved construction which may be applied with conventional capping machinery.

2. Description of the Prior Art

It is known generally to provide container closures having indicia for the purpose of accounting for a predetermined use. Evidence of known prior art shown in U.S. Pat. No. 2,767,680 issued Oct. 23, 1956 to H. B. Lermer and U.S. Pat. No. 3,151,599 issued Oct. 6, 1964 to R. J. Livingston, both limited in scope by virtue of being a bottle package, and U.S. Pat. No. 2,817,451 issued to J. D. Giles Dec. 24, 1957, U.S. Pat. No. 3,753,417 issued Aug 21, 1973 to L. C. Garby, U.S. Pat. No. 3,921,568 issued Nov. 25, 1975 to W. J. Fish, U.S. Pat. No. 4,011,829 issued Mar. 15, 1977 to D. G. Wachsmann, U.S. Pat No. 4,220,247 issued Sept. 2, 1980 to S. G. Kramer, all of which suffer from disadvantages of difficult molding in the case of side wall indicia and or addition costs required in assembly.

SUMMARY OF THE INVENTION

It is an object of the present invention to provide a dose reminder type closure for containers having an externally threaded finish portion. It is another object of the present invention to provide a dose reminder type closure very simple in construction so as to be extremely cost effective in rapid mass production.

It is still another object of the present invention to provide a simple yet practical construction adaptable to child resistant closure wherein the reminding feature may serve as a redemption factor in view of some public aversion to the child resistant type closure.

It is the main object of the present invention to provide a dose reminder type closure whereby even a seriously decrepit patient may easily manipulate and clearly observe which dose is either past due or next due.

These and other objects are achieved according to the present invention by providing a dose reminder closure having, a two member nested closure wherein the first member is an outer cap bearing an indicator means and a positive drive means formed on the contour of the base edge. The second member is an inner cap having a flange formed around the base with graduated indicia formed there on. Further the inner cap member has threads formed on the interior surface for engagement with a threaded container and an annular groove to receive and loosely contain the outer cap.

Details of construction and operation are more fully described and claimed, referenced being had to the accompanying drawings forming a part hereof, wherein like numerals refer to like parts throughout.

DETAILED DESCRIPTION OF THE DRAWINGS

Figure 1:
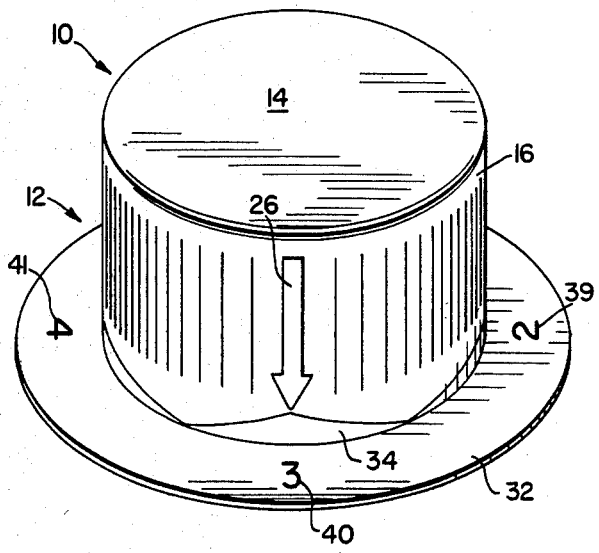
FIG. 1 is a perspective view, partially cut away of the outer cap member of the present invention.
Figure 2:
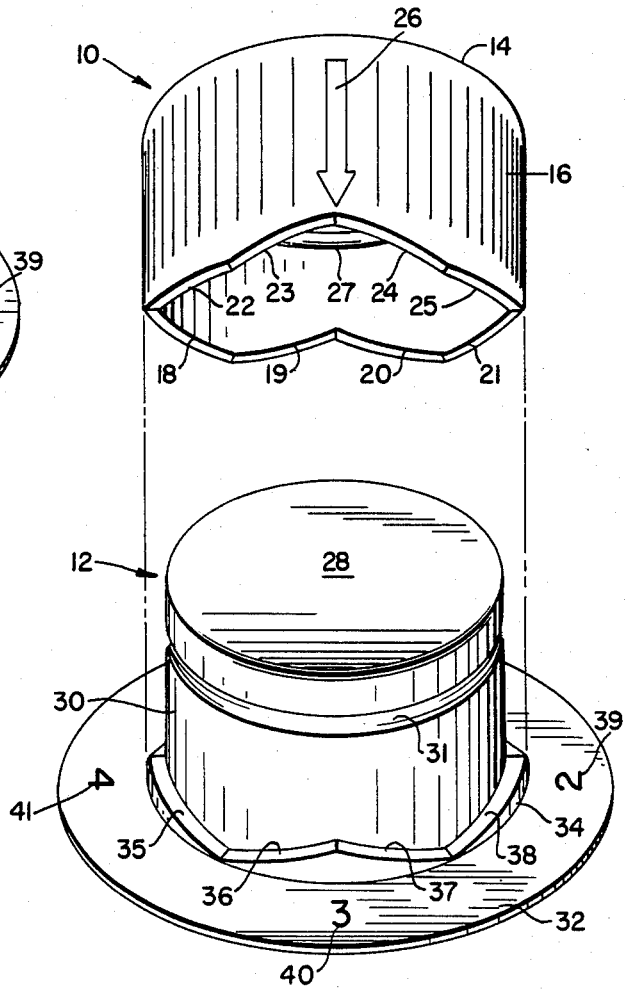
FIG. 2 is a side elevational view of the inner cap member showing the dyhedral contoured track, with the angles greatly exaggerated for visual purposes.
Figure 3:
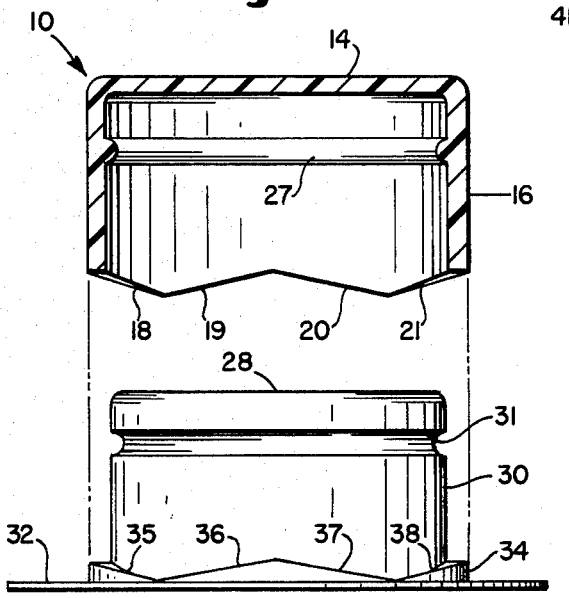
FIG. 3 is a perspective view of the outer cap member showing the dyhedral contour of the bottom edge with the angles greatly exaggerated for visual purposes.
Figure 4:
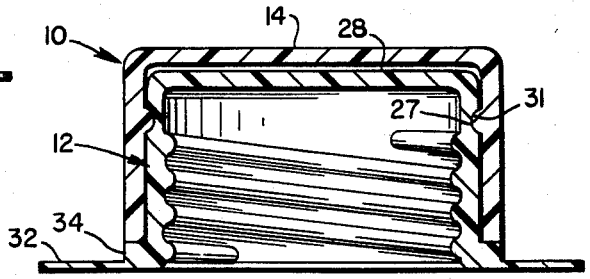
FIG. 4 is a perspective view of the inner cap member.

The closure of the present invention is manufactured of a resilient material like polyethelene and made up of two components; an outer cap member 10, shown in FIGS. 1 and 3 and an inner cap member 12 shown in FIGS. 2 and 4. With references to FIG. 1 and 3 the outer cap member 10 is formed with a circular top panel 14 integrally molded with a depending skirt portion 16. Molded into the underside of the depending skirt portion 16 are a plurality of slight angles 18, 19, 20, 21, 22, 23, 24, and 25 forming groups of dyhedral shaped contours. Molded on the outside wall of the depending skirt portion 16 is an embossed indicator 26 shown in FIG. 3. The retention bead 27 shown in FIG. 1 is molded into the interior wall of the depending skirt portion 16. The retention bead 27 is continuous around the entire circumference of the inside wall of the depending skirt portion 16.

With respect to FIGS. 2 and 4 the inner cap member 12 is formed with a circular top panel 28 integrally molded with a depending skirt portion 30. The depending skirt portion 30 has an annular recess or groove 31 formed in the outer surface thereof. The groove 31 is continuous around the entire circumference of the outside wall of the depending skirt portion 30 and is complementary in size, shape and location to the retention bead 27 shown in FIG. 1. The bottom edge of the depending skirt portion 30 is integrally formed to a flange portion 32 radially extending outward from the depending skirt portion 30. A contoured track 34 integrally formed on the top face of the flange portion 32 begins at the base of the depending skirt portion 30 and extends outwardly a distance equal to the thickness of the depending skirt portion 16 shown in FIG. 1. The contoured track 34 is continuous around the entire circumference of the outside wall of the depending skirt portion 30 and is formed in the contour of a series of alternating angles of about one degree. The angles 35, 35, 37, and 38 on the track 34 are mating surfaces to the angles 18, 19, 20, 21, 22, 23, 24, and 25 shown in FIG. 1. The portion of the flange 32 extending outwardly from the track 34 bears graduated indicia 39, 40, and 41. The portion of the flange 32 extending outwardly from the track 34 may be of such thinness as to render the flange portion 32 extremely resilient. The extreme resiliency of the flange portion 32 serves (a) to hinder or negate the improper removal of the closure. (b) To allow for closer packing in shipping containers.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A closure for containers having an exteriorly threaded portion comprising, in combination: An outer cap member having a circular top panel integrally formed with a substantially cylindrical-shaped skirt portion depending perpendicalarly downward to an open bottom, the face of said bottom being formed in the contour of a plurality of general dyhedrals, said outer cap member having an indicator means; an inner cap member having substantially a circular top panel integrally formed with a depending skirt portion, said depending skirt portion of said inner cap member loosely nested within said depending skirt portion of said outer cap member to allow relative rotary and axial movement between said inner and outer cap members, said inner cap member having threads formed on the interior surface thereof for engagement with said threaded finish portion of said container, a radially formed flange portion extending outwardly from an open bottom of said inner cap member, said flange portion having formed in combination, a set of graduated indicia clearly observable on the top face, an annular track being formed on the upper face of said flange portion, said annular track beginning at the hub of said flange portion and extending outwardly to substantially the width of the thickness of the depending skirt portion of said outer cap member, said annular track being formed with an alternating dyhedral configuration matching the contour of the base of said outer cap member.

2. The combination of claim 1, wherein said flange portion, beginning from said annular track and outward is formed of a thin and sufficiently flexable material thickness as to negate the possibility of improperly removing said closure.

3. The flange portion of claim 2, used in combination with known types of child resistant closures.

4. The closure of claim 2, wherein the top panel is omitted from the inner cap member.

* * * * *